United States Patent [19]

Reed et al.

[11] 4,207,795

[45] Jun. 17, 1980

[54] CAM FIRING MECHANISM

[75] Inventors: Jerry A. Reed, Placentia; Ronald Van Delden, Woodlake; Winfred F. Waring, Stockton; Shuji U. Maruko, Orange, all of Calif.

[73] Assignee: The United States of America as represented by the Secretary of the Army, Washington, D.C.

[21] Appl. No.: 927,714

[22] Filed: Jul. 24, 1978

[51] Int. Cl.[2] ..... F41F 3/04

[52] U.S. Cl. ..... 89/1.813; 89/27 R

[58] Field of Search ..... 89/1.813, 27 R; 42/69 R

[56] References Cited

U.S. PATENT DOCUMENTS

| | | | |
|---|---|---|---|
| 3,641,868 | 2/1972 | Reed | 89/1.813 |
| 3,750,529 | 8/1973 | Reed et al. | 89/1.813 |

*Primary Examiner*—Stephen C. Bentley

*Attorney, Agent, or Firm*—Nathan Edelberg; Robert P. Gibson; Max Yarmovsky

[57] ABSTRACT

A multi-lobed partial free-floating cam mechanism is used to cock and successively fire a plurality of biased firing pins without allowing a "hang-fire" condition to exist. Initial lifting of the cam mechanism by pivot pin rollers acting on an inclined cam slot stores enough energy to drive the cam through its final rotational mode.

2 Claims, 3 Drawing Figures

CAM FIRING MECHANISM

GOVERNMENTAL INTEREST

The invention described herin was made in the course of a contract with the Government and may be manufactured, used and licensed by or for the Government for governmental purposes without the payment to us of any royalty thereon.

BACKGROUND OF THE INVENTION

Various means have been used in the prior art to semiautomatically successively fire a plurality of projectiles from a launcher. One of the prior art means for triggering a multitube launcher utilizes a trigger handle assembly having a bellcrank linkage connected to a ratchet drive means which has an extension shaft joining the ratchet drive to a firing pin rotating cam mechanism. The aforementioned device used a rear cocking knob to precock each of the firing pins. Each pull of the trigger by an operator released one firing pin which then in turn fired the next round from the multitube launcher.

The problem with the aforementioned prior art camming mechanism was that rear hand cocking of the firing pins was a safety hazard. The system often required placing the operator's hand behind the gun in the backblast area of the rocket motor and subjected the operator to possible injury in the event of an inadvertent rocket motor firing. An unexpected firing could occur when the firing pin cam follower was stuck on the cam firing lobe peak in a "hand-fire" condition. The problem with prior art cocking devices which were located in the front or side of a multitube launcher was that they generally require the installation of additional linkages which are complex to design and costly to install.

SUMMARY OF THE INVENTION

The present invention relates to firing pin mechanism that successfully cocks and fires a plurality of biased firing pins by means of a double-lobed free-floating cam. The initial rotation of the cam which lifts the cam on pivot pin rollers stores energy which is subsequently used to help drive the cam follower over the cam firing lobe peak thereby preventing the occurrence of a "hang-fire" condition.

An object of the present invention is to provide a free-floating double-lobed cam firing mechanism which prevents a firing pin cam follower from remaining in a "hand-fire" condition on a actuating cam lobe.

Another object of the present invention is to provide a free floating double-lobed cam firing mechanism for a multitube launcher which permits trigger cocking of the firing pin mechanism with reduction of safety hazards.

A further object of the present invention is to provide a free-floating double-lobed cam firing mechanism which has enhanced reliability and safety because of reduced susceptibility to environmental contamination.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
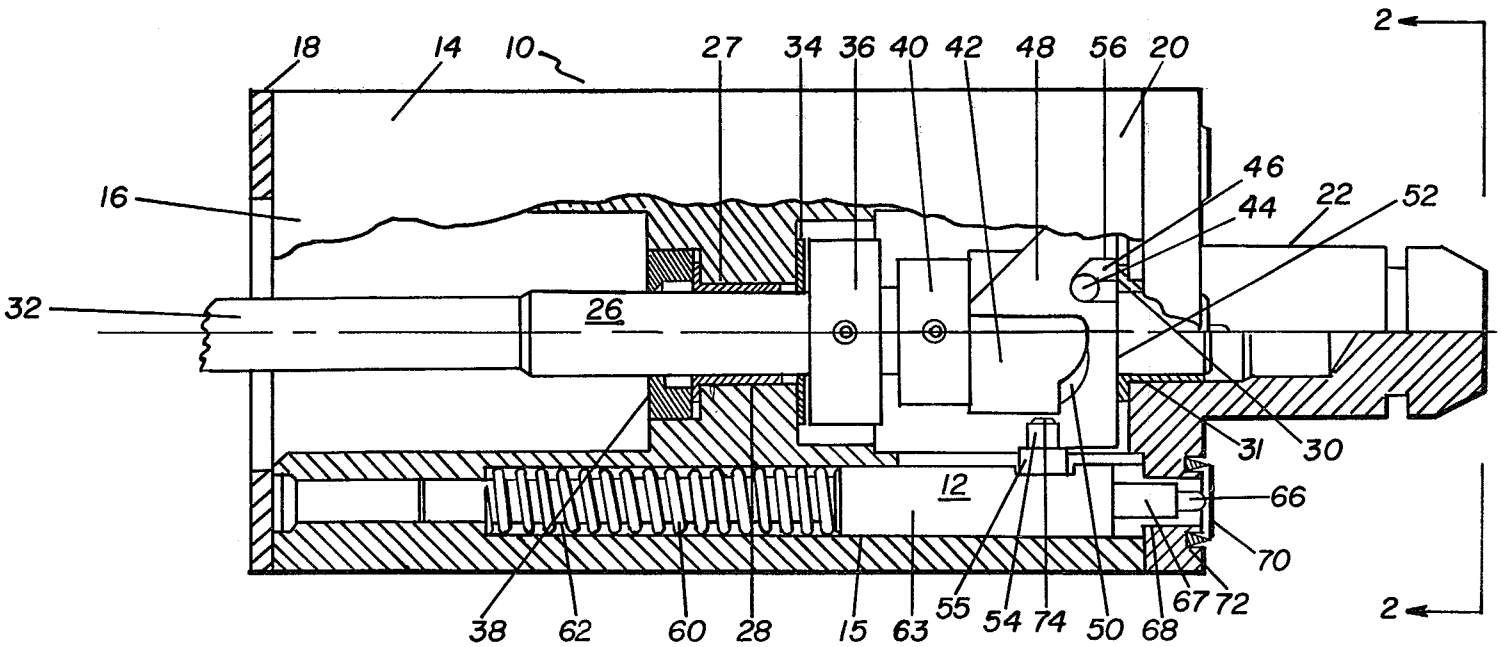
FIG. 1 is a partial cutaway longitudinal cross-sectional view of a firing pin cam mechanism assembly used in a multitube launcher.
Figure 2:
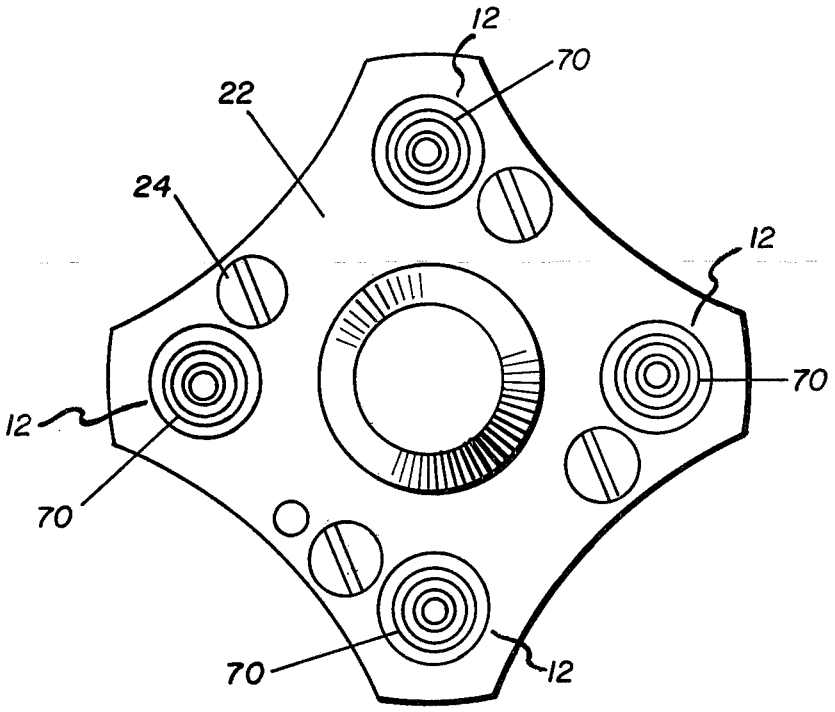
FIG. 2 is an end view of the firing pin cam mechanism assembly taken along line 2—2 of FIG. 1.
Figure 3:
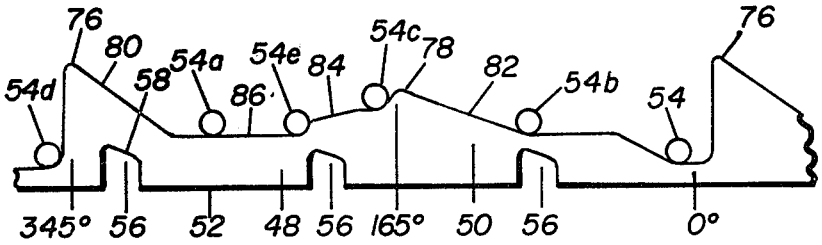
FIG. 3 is a flat stretched out pattern view of the double lobe cam member illustrated in FIG. 1.

Referring now to FIGS. 1 and 2 a firing pin mechanism assembly 10 is used in a four tube rocket launcher not shown. The assembly 10 comprises four spring biased firing pin assemblies 12 longitudinally equally spaced at 90° intervals in housing 14 in firing pin housing bores 15. For simplification only one of the four firing pin assemblies 12 are shown in FIG. 1. Housing 14 is partially closed at its rear end 16 by disk shaped bumper member 18 fixedly attached thereto and a forward end 20 by a front cover 22 which is fixedly attached to housing 14 by means of screws 24. A double-lobed free-floating cam shaft assembly 26 is axially rotatable supported on a first end in housing central drive shaft base 27 by a rear bearing member 28 and supported on a second end by a front bearing member 30 disposed in axial shaft bore 31. Rearward longitudinal movement of connecting shaft 32 is prevented by a thrust washer 34 which abuts a first pinned collar member 36. The rotational friction forces of connecting drive shaft 32 are reduced by an oil seal member 38 and bearings 28 and 30. The drive shaft assembly 26 carries a second pinned collar member 40 fixedly attached to connecting shaft 32 intermediate cam bearing sleeve 42 and first pinned collar 36. Cam bearing sleeve 42 is fixedly positioned intermediate second collar 40 and front bearing member 30 and has three transversely radially positioned equally spaced pivot pin rollers 44 fixedly attached to bearing sleeve rear end 46 and connecting shaft 32. A double-lobed free-floating cylindrically shaped cam member 48 rotatably and slidably fits on cam bearing sleeve 42. Cam member 48 has a forward cam end 50 and a rear cam end 52. Referring now to FIGS. 1, 2 and 3, cam front end 50 is in rolling contact with cam follower 54. Cam rear end 52 has three equally spaced symetrically shaped lifting notches 56 therein having sloping back edges 58 disposed on the closed end. The pivot pin rollers 44 are smaller than the notch width of cam lifting notches 56. Each of the firing pin assemblies 12 include a biased helical spring 60 operatively disposed on a firing pin shaft rear end 62 slidably positioned in housing firing pin bores 15 and a firing pin 66 on front end 67 slidably disposed in a cover firing pin bore 68. A firing pin bore 68. A firing pin cover seal 70 is operatively disposed in cover annular counter groove 72 to protect the firing pin assembly from the environment. Cam follower 54 comprises a cylindrically shaped roller 55 which is rotatably attached to a follower pin 74 which is in turn press fitted into the side of firing pin shaft 63. Cam 48, as shown in flat pattern view of FIG. 3, has a two main lobes, a "firing lobe" 76 and a "secondary lobe" 78 spaced 180° apart therefrom.

In operation, the firing pin mechanism 10 is actuated by an operator who squeezes a trigger means of the launcher, now shown, which causes connecting shaft 32 to rotate 90° clockwise, when viewed from the right-hand end, for each actuation of the trigger. The rotation of connecting shaft 32 results in a lifting of cam 48 by pivot pin roller 44 from the deep side of notch 56 to the opposite side. This lifting occurs due to the resistance of the cam 48 to rotation because of frictional loads placed thereon by the biased firing pin assemblies 12. As the connecting shaft 32 continues to rotate the cam 48 rotates as driven by pivot pin rollers 44 causing cam follower 54*a*, as shown on FIG. 3, on the firing pin assembly 12, next to be fired to roll up the firing lobe ramp 80. Simultaneously, the follower 54*b* attached to the firing pin assembly 12, located diametrically opposite to the aforementioned firing pin assembly, rolls up the ramp 82 of the secondary lobe 78. At the same instant of time, cam follower 54*c* oriented 90° from follower 54*b* passes over secondary lobe peak 78 causing the cam 48 to rotate independently of connecting shaft 32. Follower 54*d* which was previously on the firing lobe ramp 80 also advances but does not clear the peak of firing lobe 76 until the diametrically opposite follower 54*c* causes cam rotation as described above. The free-float rotation of the cam 48 caused by the passing of follower 54*c* over the peak secondary lobe 78 drives the firing lobe 78 under or past the firing pin follower 54*d* permitting the biased firing pin spring 60 to push firing pin 66 through seal 70 and to thereby initiate a munition, not shown, in the launcher. The firing pin partially cocked by the secondary lobe 78 and whose follower is numbered 54*c* is not released to the firing position but is slowly moved back down the opposite decending secondary lobe ramp 84 to an intermediate position determined by cam dwell surface 86.

The aforedescribed double-lobed, free-floating cam mechanism 10 thus mechanically cocks and fires a plurality of firing pins 66 in succession and prevents a "hang-fire" condition of a cocked firing pin on or near the peak of a cam firing lobe.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. A cam firing apparatus for sequentially initiating projectiles in a multitube launcher which comprises;

a housing having a partially closed rear end, a forward end, a central axially positioned central drive shaft bore, and a plurality of diametral longitudinally positioned firing pin housing bores disposed therein;

biased firing pin assembly means operatively disposed in each of said firing pin housing bores for successively firing projectiles in said multitube launcher which includes;

a firing pin shaft having a rear end and a front end, said shaft slidably disposed in a longitudinally positioned firing pin housing bore;

a helical spring biasedly positioned on said firing pin shaft rear end, said helical spring urging said firing pin assembly means toward said seal cover means, a follower pin transversely fixedly positioned in said firing pin shaft;

a cylindrically shaped cam follower member rotatably positioned on said follower pin and in contact with a forward end of said cam means; and a firing pin operatively disposed on said front end of said firing pin shaft;

seal-cover means fixedly attached to said forward end of said housing for protecting said biased firing pin means from an ambient environment which includes;

a front housing cover screwedly fixed to said housing forward end, a plurality of cover firing pin bores transversely disposed therethrough and axially aligned with said firing pin housing bores, an axial cover shaft bore for operatively holding therein a front bearing member, and a cover annular counter groove in axial alignment with said cover firing pin bore; and a cover seal fixedly disposed in said cover annular counter groove, said cover seal adapted to allow said firing pin to penetrate therethrough when a biased firing pin assembly is initiated;

drive shaft means axially rotatably supported in said central drive shaft bore of said housing and in said seal-cover means for providing torque to said cam firing apparatus which includes;

a connecting shaft rotatably axially disposed in said bearing means and in said housing;

a first collar member fixedly pinned to said connecting shaft;

a thrust washer operatively disposed intermediate said housing and said first collar member, said thrust washer preventing rearward longitudinal movement of said connecting shaft;

a second collar member fixedly pinned to said connecting shaft;

a cam bearing sleeve axially positioned on said connecting shaft intermediate said second collar member and said seal-cover means; and a plurality of equally spaced cam lifting pivot pin rollers transverselly press fit into the rear end of said bearing sleeve and said connecting shaft;

bearing means operatively disposed in said central drive shaft bore, in said seal-cover means and on said drive shaft means for reducing the rotational frictional forces between said drive shaft means and said housing and said seal cover means; and double-lobe free-floating cam means slidably rotatably and operatively disposed on said drive shaft means and in contact with said biased firing pin assembly means, said cam means having forward and rear cam ends adapted to simultaneously cock and sequentially release a biased firing pin assembly without incurring a "hang-fire" condition.

2. A cam firing apparatus as recited in claim 1 wherein said double-lobe free-floating cam means includes:

a cylindrically shaped cam member rotatably and slidably positioned on said cam bearing sleeve, having a forward cam end and a rear cam end, said forward end being in rolling contact with a plurality of said cam follower members, said rear cam end having a plurality of equally spaced sloping back notches therein, said cam lifting pivot pin rollers operatively disposed in said sloping back notches, said forward cam end having a main "firing lobe" and a "secondary lobe" positioned 180° therefrom;

wherein when said connecting shaft is rotated 90° in a clockwise direction said pivot pin rollers lift said cam member and move from a deep side of said sloping notches to the opposite side of said notches of said cam member causing a first cam follower connected to a first firing pin assembly, next to be fired, to roll up a ramp of said firing lobe, said connecting shaft rotation simultaneously causes a second cam follower connected to a second firing pin assembly located diametrically opposite to said first firing pin assembly to roll up a ramp of said secondary lobe, simultaneously a third cam follower oriented 90° from said second cam follower passes over the peak of said secondary lobe causing said cam member, in its free-floating condition, to rotate independently of said connecting shaft driving a fourth cam follower of a fourth firing pin assembly to be pushed over the peak of said firing lobe of said cam member thereby preventing said fourth cam follower and said fourth firing pin assembly from remaining in a "hang-fire" condition and cocking a third firing pin assembly connected to said third cam follower.

* * * * *